US006999029B2

(12) United States Patent
Nakano et al.

(10) Patent No.: US 6,999,029 B2
(45) Date of Patent: Feb. 14, 2006

(54) ANTENNA APPARATUS INCLUDING A FLAT-PLATE RADIATION ELEMENT AND IMPROVED IN RADIATION CHARACTERISTIC

(75) Inventors: Hisamatsu Nakano, 4-6-7-101, Jousuiminami-cho, Kodaira-shi, Tokyo (JP); Akira Miyoshi, Akita (JP); Masaaki Miyata, Sagamihara (JP)

(73) Assignees: Mitsumi Electric Co., Ltd., Tama (JP); Hisamatsu Nakano, Kodaira (JP)

( * ) Notice: Subject to any disclaimer, the term of this patent is extended or adjusted under 35 U.S.C. 154(b) by 2 days.

(21) Appl. No.: 10/787,449

(22) Filed: Feb. 25, 2004

(65) Prior Publication Data

US 2004/0189532 A1 Sep. 30, 2004

(30) Foreign Application Priority Data

Mar. 31, 2003 (JP) ..... 2003-096576

(51) Int. Cl.
*H01Q 1/38* (2006.01)

(52) U.S. Cl. ..... 343/700 MS

(58) Field of Classification Search ..... 343/700 MS, 343/789, 718, 781
See application file for complete search history.

(56) References Cited

U.S. PATENT DOCUMENTS

| | | | | |
|---|---|---|---|---|
| 4,242,685 | A * | 12/1980 | Sanford | 343/770 |
| 6,049,309 | A * | 4/2000 | Timoshin et al. | 343/700 MS |
| 6,373,446 | B1 * | 4/2002 | Apostolos | 343/797 |
| 6,731,243 | B1 * | 5/2004 | Taira et al. | 343/700 MS |
| 6,842,141 | B1 * | 1/2005 | Suh et al. | 343/700 MS |

FOREIGN PATENT DOCUMENTS

| | | |
|---|---|---|
| JP | 2001-339234 A | 12/2001 |
| JP | 2002-198725 A | 7/2002 |
| JP | 2002-237714 A | 8/2002 |

* cited by examiner

*Primary Examiner*—Thuy V. Tran
*Assistant Examiner*—Huedung X. Cao
(74) *Attorney, Agent, or Firm*—Frishauf, Holtz, Goodman & Chick, P.C.

(57) ABSTRACT

An antenna apparatus includes a dielectric substrate, a radiation element buried in the dielectric substrate, and a feeding lead connected to the radiation element and extending outward from the dielectric substrate. The dielectric substrate is covered with a conductor cover except at an exposed portion left on an upper surface thereof. The conductor cover comprises a side wall portion extending in a thickness direction of the radiation element and covering all side surfaces of the dielectric substrate, and a hood portion extending from an upper edge of the side wall portion and covering a part of the upper surface of the dielectric substrate. The hood portion has a trapezoidal or a rectangular shape.

8 Claims, 8 Drawing Sheets

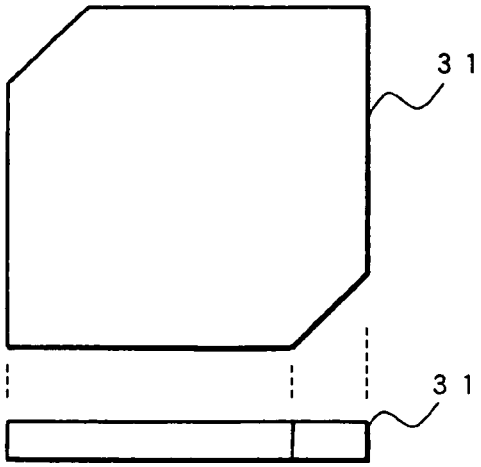
FIG. 5A
FIG. 5B
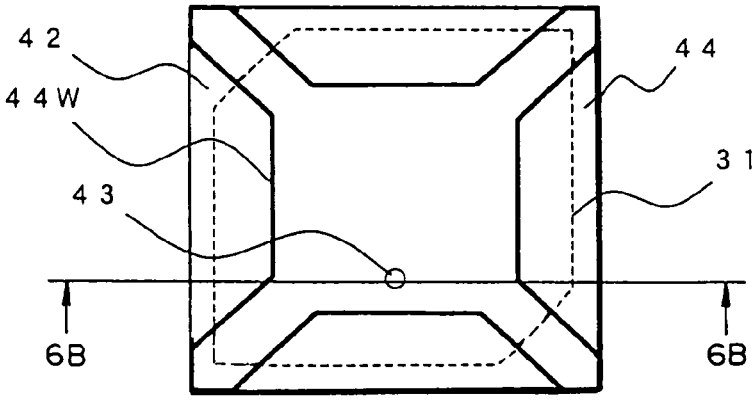
FIG. 6A
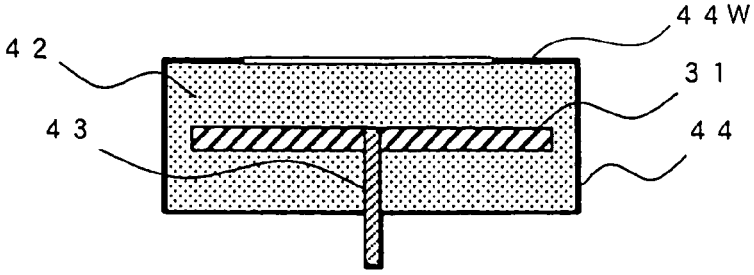
FIG. 6B $f = 2.33875$ [GHz]

$\Delta x = \Delta y = \Delta z = 0.010325\ \lambda_{2.3} \equiv \Delta \fallingdotseq 1.325$ [mm]

$L_P = 36\Delta \fallingdotseq 47.68$ [mm]

$\Delta L = 8\Delta \fallingdotseq 10.60$ [mm]

$d_F = 11\Delta \fallingdotseq 14.11$ [mm]

$h_P = 2\Delta \fallingdotseq 2.57$ [mm]

$\varepsilon_r = 1$ $d_W = 6\Delta \fallingdotseq 7.95$ [mm]

$W = 10\Delta \fallingdotseq 12.83$ [mm]

$h_W = 4\Delta \fallingdotseq 5.14$ [mm]

$L_W = 48\Delta \fallingdotseq 63.57$ [mm]

FIG. 8

$f = 2.33875$ [GHz]

$\Delta x = \Delta y = \Delta z = 0.010325\ \lambda_{2.3} \equiv \Delta \fallingdotseq 1.325$ [mm]

$L_P = 36\Delta \fallingdotseq 47.68$ [mm]

$\Delta L = 9\Delta \fallingdotseq 11.925$ [mm]

$d_F = 11\Delta \fallingdotseq 14.11$ [mm]

$h_P = 2\Delta \fallingdotseq 2.57$ [mm]

$\varepsilon_r = 1$ $l_L = 14\Delta \fallingdotseq 18.55$ [mm]

$l_S = 10\Delta \fallingdotseq 12.83$ [mm]

$h_W = 4\Delta \fallingdotseq 5.14$ [mm]

$L_W = 48\Delta \fallingdotseq 63.57$ [mm]

FIG. 12

ANTENNA APPARATUS INCLUDING A FLAT-PLATE RADIATION ELEMENT AND IMPROVED IN RADIATION CHARACTERISTIC

This application claims priority to prior Japanese application JP 2003-96576, the disclosure of which is incorporated herein by reference.

BACKGROUND OF THE INVENTION

This invention relates to an antenna apparatus and, in particular, to an antenna apparatus including a flat-plate radiation element.

Generally, an antenna apparatus of the type comprises a dielectric substrate, a flat-plate radiation element disposed on the dielectric substrate, and a feeding lead connected to the radiation element and extracted outward through the dielectric substrate. Such antenna apparatus is disclosed, for example, in Japanese Patent Application Publication (JP-A) No. 2002-198725. Referring to FIG. 1, this antenna apparatus comprises a flat-plate radiation element 11 of a generally square shape disposed on an upper surface of a dielectric substrate 12 of a generally rectangular shape, a one-point feeding member 13 located at an offset position of the radiation element 11, and a grounding conductor member 14 having a generally rectangular shape and attached throughout an entire region of a lower surface of the dielectric substrate 12. Although not shown in the figure, a ground electrode is adhered to the grounding conductor member 14. A combination of the radiation element 11 and the dielectric substrate 12 forms a patch antenna. With the above-mentioned structure, it is possible to set the best axial ratio for a signal frequency of a circular polarization signal to be transmitted and received.

Another existing antenna apparatus is disclosed, for example, in Japanese Patent Application Publication (JP-A) No. 2002-237714. As shown in FIG. 2, this patch antenna comprises a flat-plate radiation element 21 disposed on an insulation substrate 22, a feeding member 23 located at an offset position, a ground conductor 24 disposed throughout an entire region of an upper surface of the insulation substrate 22, and a dielectric member 25 placed on the ground conductor 24 at a position where an electric field strength is weak. The radiation element 21 is spaced from the ground conductor 24 by the presence of the dielectric member 25 interposed therebetween. With the above-mentioned structure, it is possible to obtain a patch antenna with higher gain.

Still another existing antenna apparatus using a circular polarization antenna is disclosed, for example, in Japanese Patent Application Publication (JP-A) No. 2001-339234. For example, in a circular polarization antenna for use in GPS (Global Positioning System), a flat-plate radiation element has a six-sided shape formed by trimming a square shape by cutting off two corners opposite to each other along a diagonal line.

As shown in FIGS. 3 and 4A and 4B, the antenna apparatus comprises a radiation element 31 disposed on an upper surface of a dielectric substrate 32, a feeding lead 33 located at an offset position of the radiation element 31, and a ground conductor 34 attached to a lower surface of the dielectric substrate 32. The feeding lead 33 passes through the dielectric substrate 32 and the ground conductor 34 to protrude outward.

The patch antenna or the antenna apparatus described in conjunction with FIGS. 1 to 4B is broadly adopted in an on-vehicle or a pocket navigation system of the GPS system using an electrical wave received from a satellite, i.e., a satellite wave.

In recent years, a digital radio receiver, which receives the satellite wave or the ground wave so as to listen to digital radio broadcasting, has been developed and is put into practical use in the United States of America. The digital radio receiver is mounted on a mobile station, such as an automobile, and can receive an electric wave having a frequency of about 2.338 gigahertz (GHz) to listen to the digital radio broadcasting. That is, the digital radio receiver is a radio receiver adapted to listen to mobile broadcasting. In addition, the ground wave is an electric wave obtained by slightly shifting the frequency of the satellite wave after it is received by an earth station.

In order to receive the electric wave having the frequency of about 2.338 GHz, it is necessary to dispose an antenna outside the automobile. A variety of types of antennas having various structures have been proposed. Generally, cylindrical antennas are frequently used rather than planer or flat antennas. This is because a wider directivity is achieved by forming the antenna into a cylindrical shape.

As well known in the art, an electromagnetic wave radiated in a free space is a transverse wave having electric and magnetic fields which oscillate at right angles with respect to each other within a plane perpendicular to a traveling direction of the wave. Each of the electric field and the magnetic field is variable in strength within the above-mentioned plane. The electromagnetic wave having the above-mentioned feature is called a polarized wave or polarization. Thus, the polarized wave is an electromagnetic radiation in which the direction of the electric field vector is not random. The satellite wave is a circular polarization while the ground wave is a linear polarization.

As described above, the on-vehicle or the pocket antenna apparatus, which can be mounted at any position and does not protrude from a body of the automobile or a housing of a mobile equipment, is wide spread for use in the GPS system. Moreover, it is desired that such antenna apparatus is effectively applied also to the digital radio broadcasting.

However, each of the existing patch antennas or the existing antenna apparatuses described above has a radiation characteristic intended to the GPS system accommodating a limited number of satellites. In other words, each of the antennas described above does not have such a wide directivity achieved by the cylindrical antenna and adaptable to the digital radio broadcasting. As a result, the above-mentioned antenna having the flat-plate radiation element is disadvantageous in that it is unsuitable for the digital radio broadcasting.

SUMMARY OF THE INVENTION

It is therefore an object of the present invention to provide an antenna apparatus which is improved in radiation characteristic and is therefore applicable to digital radio broadcasting.

Generally, the radiation characteristic of the antenna can be improved by enclosing an antenna element with a cylindrical conductor so as to increase an electromagnetic coupling area and to increase a half-angle.

According to the present invention, an antenna apparatus is provided which has an integral structure and which comprises a flatplate radiation element (31) buried in a dielectric substrate (42, 52) at its center portion, and a conductor cover (44, 54) having side wall portions extending in a thickness direction of the radiatior element (31) and covering all of side surfaces of the dielectric substrate and hood portions (44W, 54W) extending from upper edges of the side wall portions and covering a part of an upper surface of the dielectric substrate.

According to one aspect of the present invention, each of the hood portions (44W) has a trapezoidal shape whose base is coincident with a peripheral side of the upper surface of the dielectric substrate (42). The hood portions partially cover the upper surface of the dielectric substrate (42) so as to leave an exposed portion having a rectangular center portion and a plurality of strip-like peripheral portions extending outward from four corners of the rectangular center portion along diagonal lines.

According to a different aspect of the present invention, each of the hood portions (54W) has a rectangular shape whose base is coincident with a peripheral side of the upper surface of the dielectric substrate (52). The hood portions partially cover the upper surface of the dielectric substrate (52) so as to leave an exposed portion having a rectangular center portion and a plurality of rectangular peripheral portions with their inner corners overlapping four corners of the rectangular center portion, respectively.

BRIEF DESCRIPTION OF THE DRAWINGS

FIGS. 5A and 5B are a plan view and a side view of a radiation element according to the present invention, respectively;

FIG. 6A is a plan view showing an antenna apparatus according to a first embodiment of this invention;

FIG. 6B is a sectional view taken along a line 6B—6B in FIG. 6A;

FIG. 8 shows specific values as an example of the dimensions of the antenna apparatus illustrated in FIGS. 7A and 7B;

FIG. 12 shows specific values as an example of the dimensions of the antenna apparatus illustrated in FIG. 11.

DESCRIPTION OF THE PREFERRED EMBODIMENTS

Now, a few preferred embodiments of the present invention will be described with reference to the drawings. It is noted here that specific shapes and dimensions shown in the figures are no more than illustrative examples and may be somewhat different from actual shapes and dimensions.

Figure 1:
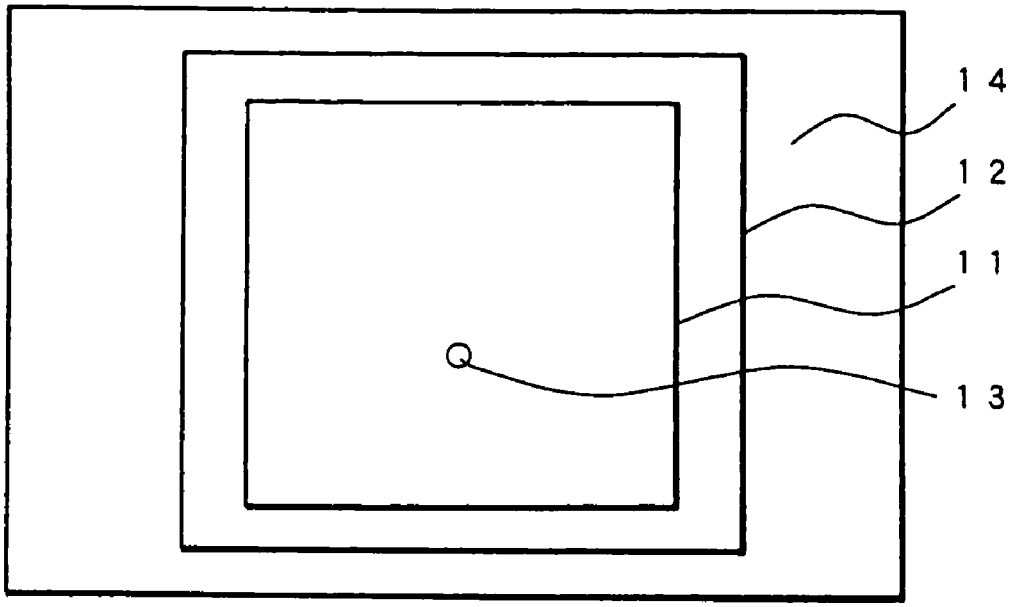
FIG. 1 PRIOR ART
FIG. 1 is a plan view of an existing antenna apparatus.
Figure 2:
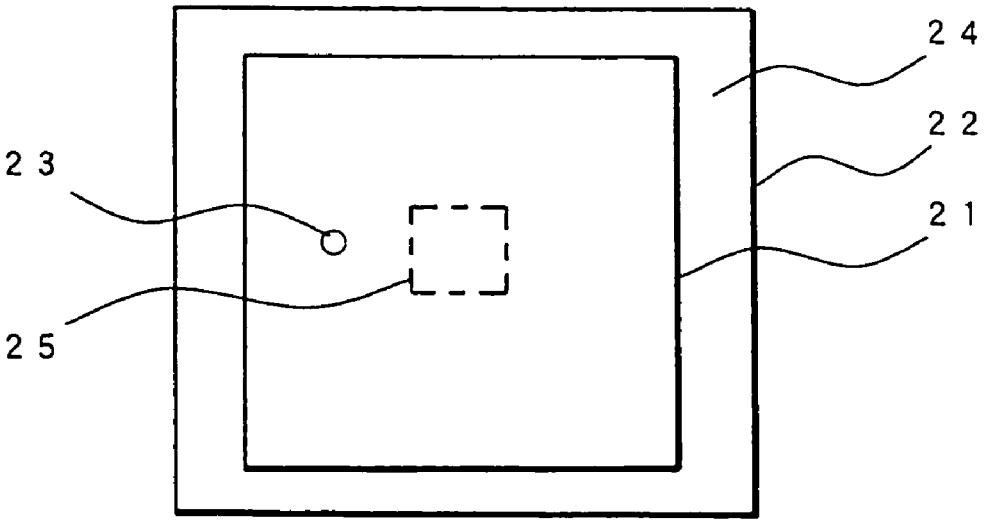
FIG. 2 PRIOR ART
FIG. 2 is a plan view of another existing antenna apparatus.
Figure 3:
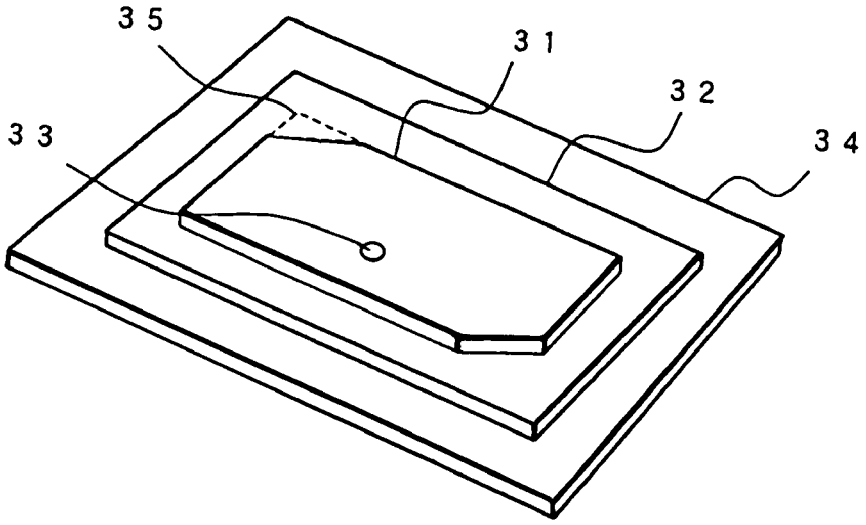
FIG. 3 PRIOR ART
FIG. 3 is a perspective view of still another existing antenna apparatus.
Figure 4A:
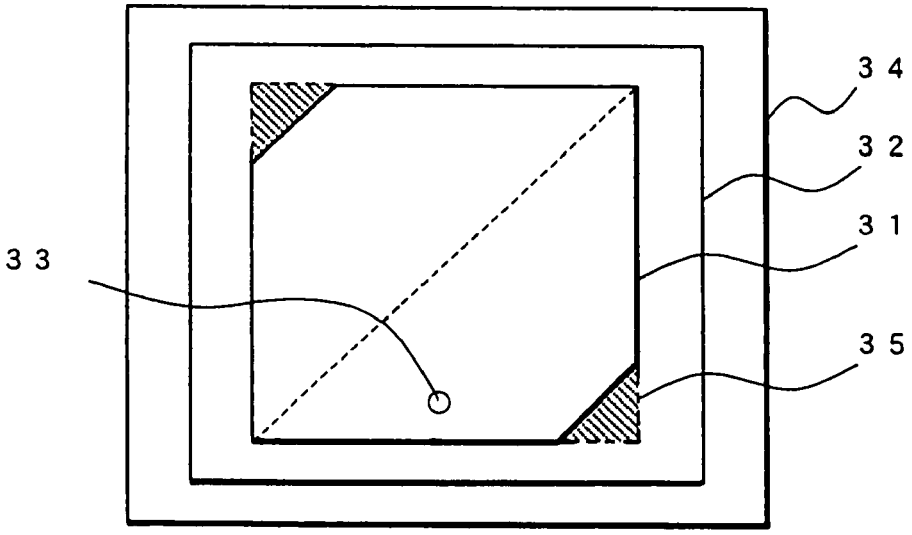
FIG. 4A PRIOR ART
FIG. 4A is a plan view of the antenna apparatus illustrated in FIG. 3.
Figure 4B:
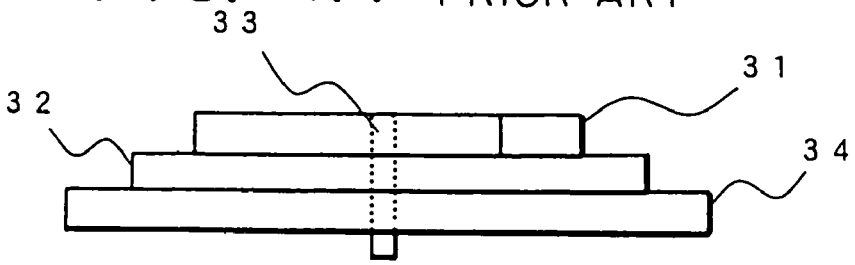
FIG. 4B PRIOR ART
FIG. 4B is a side view of the antenna apparatus illustrated in FIG. 3.

Referring to FIGS. 5A and 5B, a radiation element 31 according to the present invention has a six-sided or a hexagonal shape obtained by trimming a square shape by cutting off two corners (corresponding to 35 in FIG. 4A) opposite to each other along a diagonal line to form cut portions.

Referring to FIGS. 6A and 6B, an antenna apparatus according to a first embodiment of this invention comprises a flat-plate radiation element 31, a dielectric substrate 42, a feeding lead 43, and a conductor cover 44. The radiation element 31 is buried in the dielectric substrate 42 at its center portion. The dielectric substrate 42 is made of a dielectric material, such as a polytetrafluoroethylene, and has a rectangularly configured body. The dielectric substrate 42 completely encloses the radiation element 31. The feeding lead 43 serves to energize the radiation element 31. The feeding lead 43 is connected to the radiation element 31 at an offset position on the plane of the radiation element 31 and is extracted outward (downward in the figure) from a lower surface of the dielectric substrate 42. Although not shown in the figure, a ground conductor is attached to the lower surface of the dielectric substrate 42 and penetrated by the feeding lead 43.

The conductor cover 44 as a characteristic part of the present invention has four side wall portions and four hood portions 44W. The side wall portions extend in a thickness direction of the radiation element 31 and cover all of side surfaces of the dielectric substrate. The four hood portions 44W extend from upper edges of the side wall portions and cover a part of the upper surface of the dielectric substrate 42. Each of the hood portions 44W has a trapezoidal shape extending from each of upper edges of the side wall portions and coves a part of the upper surface of the dielectric substrate 42. Except those parts covered by the hood portions 44W, the upper surface of the dielectric substrate 42 has an exposed portion having a generally square center portion and four strip-like peripheral portions extending outward from four corners of the square center portion along diagonal lines.

Figure 7A:
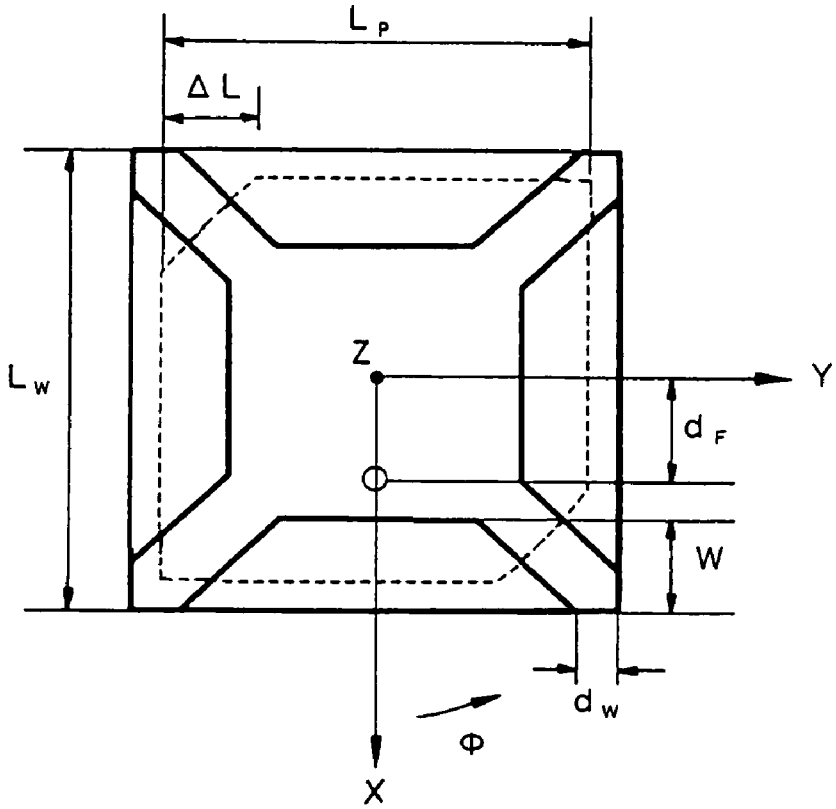
FIG. 7A is a view similar to FIG. 6A with indications of dimensions.
Figure 7B:
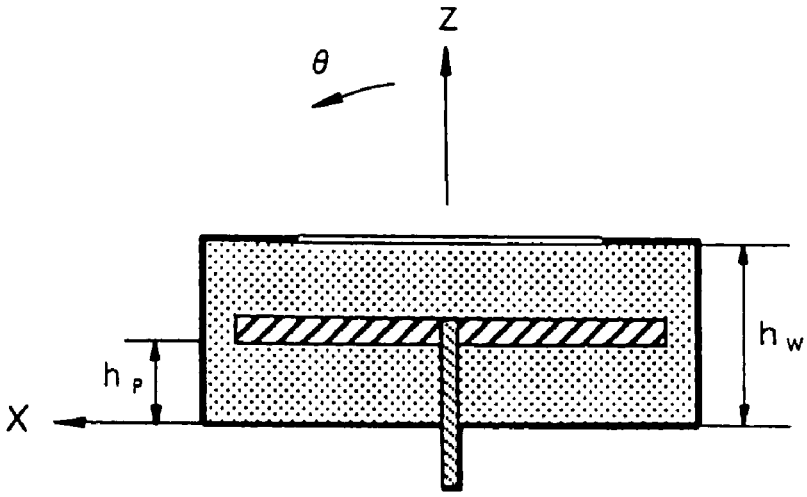
FIG. 7B is a view similar to FIG. 6B with indication of dimensions.

Referring to FIGS. 7A, 7B, and 8, the antenna apparatus shown in FIGS. 6A and 6B will be described more in detail.

The radiation element 31 is placed inside the dielectric substrate 42 at its center portion and has, on an X-Y plane, a six-sided or a hexagonal shape as described in conjunction with FIG. 5A. The radiation element 31 has a maximum width or transversal length $L_P$ of about 47.7 mm. The distance $h_P$ between a lower surface of the radiation element 31 and the lower surface of the dielectric substrate 42 is equal to about 2.6 mm. On each side of the upper surface of the dielectric substrate 42, the length $\Delta L$ of the cut portion is equal to about 10.6 mm. The dielectric substrate 42 has a square shape on the X-Y plane and has a side length $L_W$ of about 63.6 mm and a thickness $h_W$ of about 5.1 mm in a Z axis direction. The feeding lead 43 is placed on the radiation element 31 at a position $d_P$ spaced by about 14.1 mm from a center point in an X axis direction. Each of the hood portions 44W of a trapezoidal shape has a width W of about 12.8 mm and a bottom length ($L_W$–$d_W$×2) shorter than the side length $L_W$ (63.6 mm) of the dielectric substrate 42 by twice the length $d_W$ of about 8 mm.

Figure 9:
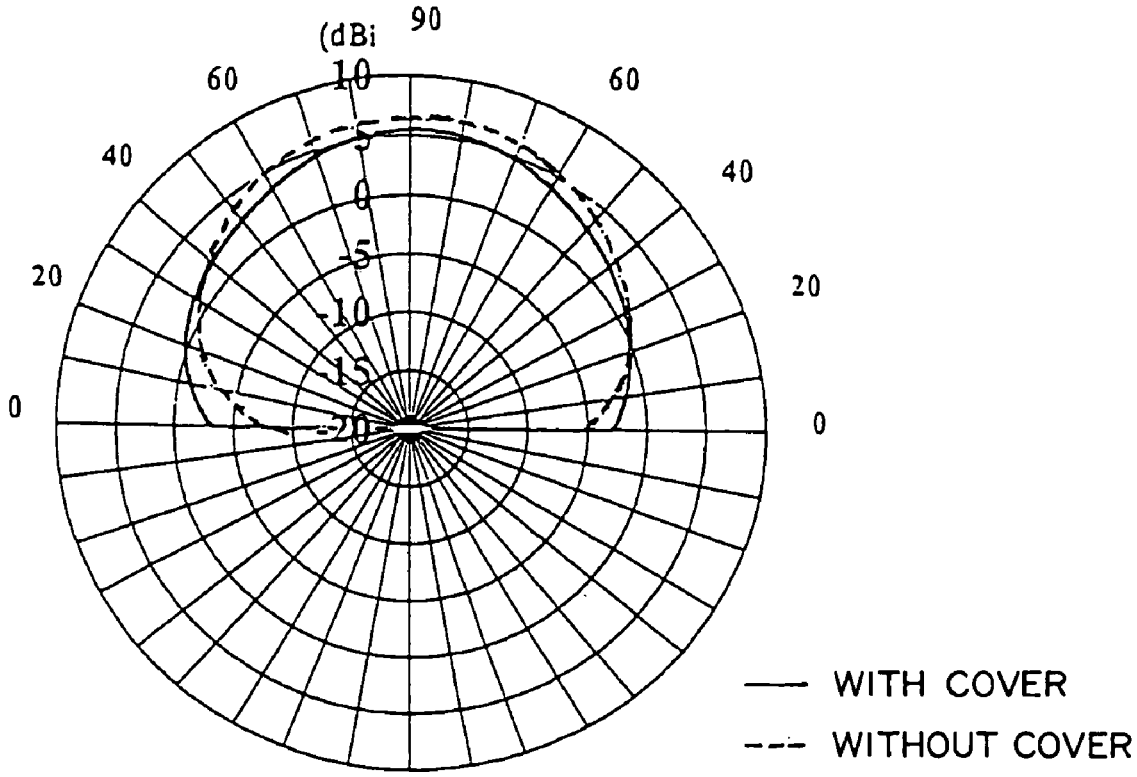
FIG. 9 shows the radiation characteristic of the antenna apparatus with the dimensions specified in FIG. 8.

The above-mentioned components are formed into an integral structure. The integral structure may further include a ground conductor or a ground electrode fixedly attached to the lower surface of the dielectric substrate. Referring to FIG. 9, a radiation characteristic of the antenna apparatus with the structure shown in FIGS. 7A, 7B, and 8 will be described below. As illustrated in FIG. 9, the conductor cover 44 according to the present invention improves the radiation characteristic in the horizontal direction although the sensitivity at a peak point is slightly degraded, as compared with the case without the conductor cover.

Figure 10:
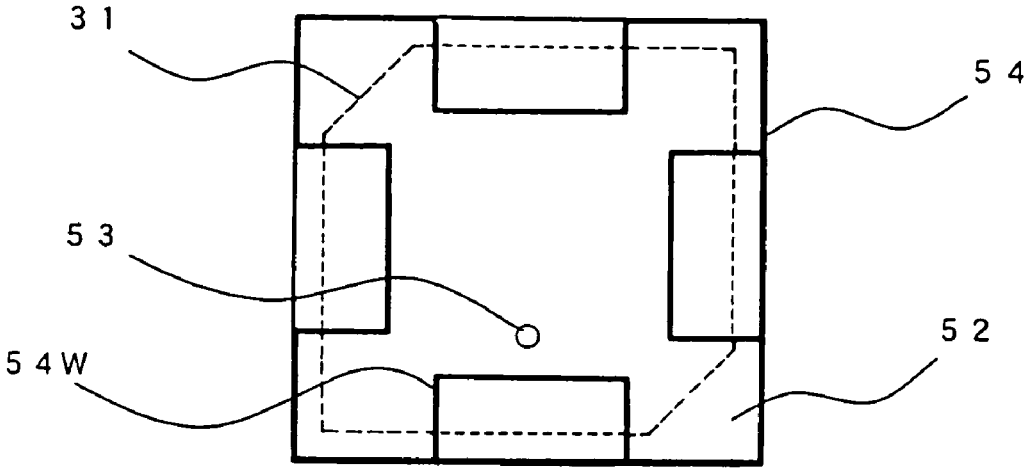
FIG. 10 is a plan view showing an antenna apparatus according to a second embodiment of this invention.
Figure 11:
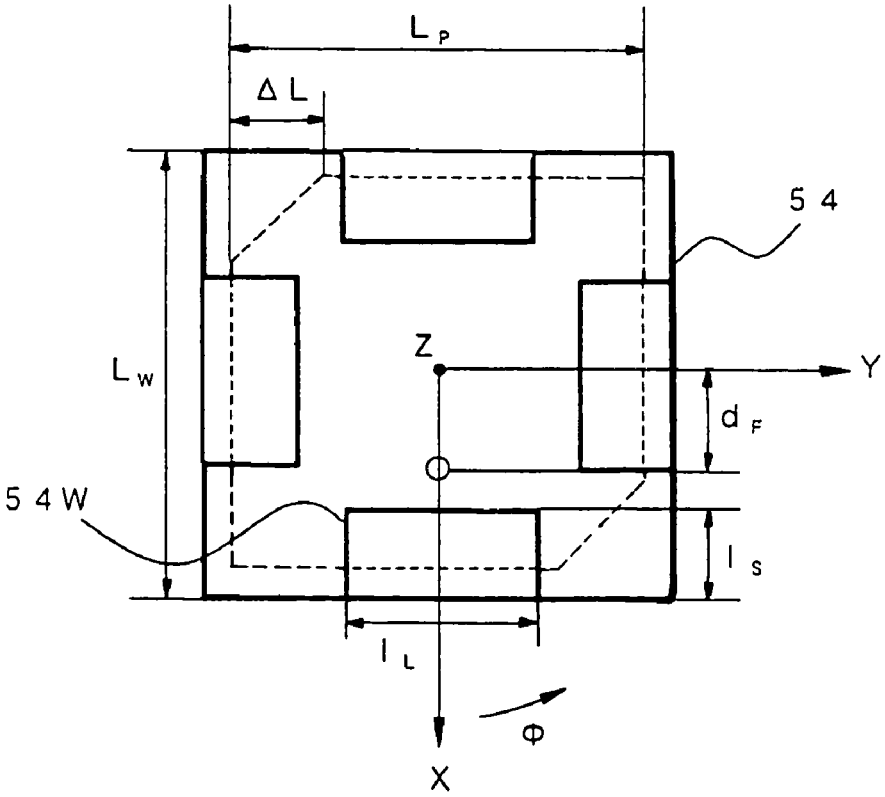
FIG. 11 is a plan view similar to FIG. 10 with indications of dimensions.

Referring to FIGS. 10 to 12, an antenna apparatus according to a second embodiment of this invention will be described. The antenna apparatus comprises a radiation element 31, a dielectric substrate 52, a feeding lead 53, and a conductor cover 54. The conductor cover 54 has a plurality of hood portions each of which has a rectangular shape different from the trapezoidal shape in the first embodiment described above.

The radiation element 31 is placed inside the dielectric substrate 52 at its center portion and has, on an X-Y plane, a six-sided or a hexagonal shape as described in conjunction with FIG. 5A. The radiation element 31 has a transversal length $L_P$ of about 47.7 mm. The distance $h_P$ between a lower surface of the radiation element 31 and a lower surface of the dielectric substrate 52 is equal to about 2.6 mm. On each side of an upper surface of the dielectric substrate 52, the length $\Delta L$ of the cut portion is equal to about 11.9 mm. The dielectric substrate 52 has a square shape on the X-Y plane, and has a side lengths $L_W$ of about 63.6 mm and a thickness $h_W$ of about 5.1 mm in a Z axis direction. The feeding lead 53 is placed on the radiation element 31 at a position $d_P$ spaced by about 14.1 mm from a center point in an X axis direction. Each of the hood portions 54W of a rectangular shape has a length $l_L$ (in a Y axis direction) of about 18.6 mm and a width $l_S$ (in the Z axis direction) of about 12.8 mm.

In case of the second embodiment also, the radiation characteristic of the antenna apparatus is improved and is substantially similar to that shown in FIG. 9.

In the foregoing description, the dielectric substrate has a rectangularly configured body. However, the dielectric substrate may have any other appropriate shape as far as the radiation element is buried in the dielectric substrate. In the foregoing description, the radiation element has the six-sided shape obtained by trimming the square shape. However, the radiation element may have any other appropriate shape. For example, the radiation element having a square shape is desired for a single-frequency application. On the other hand, for the multi-frequency application, the radiation element is desired to have a rectangular shape or a six-sided shape obtained by trimming the rectangular shape in the manner mentioned above. Each of the hood portions of the conductor cover may be formed into any other appropriate shape or any other appropriate size which is suitable for the type of a signal to be transmitted and received.

While the present invention has been described in detail in conjunction with a few preferred embodiments thereof, the present invention is not limited to the foregoing description but can be modified in shape and dimension in various other manners without departing from the scope of the invention set forth in the appended claims.

As apparent from the foregoing description, the structure according to the present invention improves the radiation characteristic of the patch antenna and is therefore applicable generally to various types of antenna apparatus for digital broadcasting.

What is claimed is:

1. An antenna apparatus, comprising:

a dielectric substrate made of a dielectric material;

a flat-plate radiation element buried inside the dielectric substrate at a center portion of the dielectric substrate;

a feeding lead connected to the radiation element and extending outward from a lower surface of the dielectric substrate through the inside thereof; and a conductor cover covering at least side surfaces of the dielectric substrate;

wherein the conductor cover comprises: (a) a side wall portion extending in a thickness direction of the radiation element such that the conductor cover covers all of the side surfaces of the dielectric substrate, and (b) at least one hood portion extending from an upper edge of the side wall portion so as to cover a part of an upper surface of the dielectric substrate.

2. An antenna apparatus according to claim 1, wherein a body of the dielectric substrate is rectangularly configured.

3. An antenna apparatus according to claim 1, wherein:

the at least one hood portion comprises a plurality of said hood portions, each of which has a trapezoidal shape including a base that is coincident with a peripheral side of the upper surface of the dielectric substrate; and the upper surface of the dielectric substrate comprises an exposed portion, which is not covered with the hood portions, and which includes a rectangular center portion and a plurality of strip-like peripheral portions extending outward from a plurality of corners of the rectangular center portion along diagonal lines thereof.

4. An antenna apparatus according to claim 1, wherein:

the at least one hood portion comprises a plurality of said hood portions, each of which has a rectangular shape including a base that is coincident with a peripheral side of the upper surface of the dielectric substrate; and the upper surface of the dielectric substrate comprises an exposed portion, which is not covered with the hood portions, and which includes a rectangular center portion and a plurality of rectangular peripheral portions having inner corners which overlap four corners of the rectangular center portion, respectively.

5. An antenna apparatus according to claim 1, wherein the radiation element has a rectangular shape.

6. An antenna apparatus according to claim 5, wherein the rectangular shape is a square shape.

7. An antenna apparatus according to claim 1, wherein the radiation element has a six-sided shape obtained by trimming a rectangular shape by cutting off two corners opposite to each other along a diagonal line of the rectangular shape.

8. An antenna apparatus according to claim 1, wherein the dielectric substrate, the radiation element, the feeding lead, and the conductor cover are formed into an integral structure.

* * * * *